US007111614B1

(12) United States Patent
Coldren et al.

(10) Patent No.: US 7,111,614 B1
(45) Date of Patent: Sep. 26, 2006

(54) SINGLE FLUID INJECTOR WITH RATE SHAPING CAPABILITY

(75) Inventors: Dana R. Coldren, Fairbury, IL (US); Daniel R. Ibrahim, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/214,346

(22) Filed: Aug. 29, 2005

(51) Int. Cl.
*F02M 59/44* (2006.01)
*F02M 59/46* (2006.01)

(52) U.S. Cl. ..... 123/467; 123/299

(58) Field of Classification Search ..... 123/467, 123/299, 300, 305, 506; 239/96, 88
See application file for complete search history.

(56) References Cited

U.S. PATENT DOCUMENTS 3,837,324 A 9/1974 Links
3,921,604 A 11/1975 Links
4,349,152 A 9/1982 Akagi
4,475,515 A 10/1984 Mowbray
4,603,671 A 8/1986 Yoshinaga et al.
5,526,791 A * 6/1996 Timmer et al. ..... 123/467
5,664,545 A 9/1997 Kato et al.
5,826,562 A 10/1998 Chen et al.
5,832,899 A 11/1998 Soteriou
5,893,350 A * 4/1999 Timms ..... 123/467
5,915,623 A 6/1999 Knight et al.
5,984,200 A 11/1999 Augustin
6,024,296 A 2/2000 Wear et al.
6,029,632 A * 2/2000 Augustin ..... 123/506
6,276,335 B1 8/2001 Egler et al.
6,283,441 B1 9/2001 Tian
6,305,358 B1 10/2001 Lukich
6,422,211 B1 7/2002 Boecking
6,431,148 B1 8/2002 Guggenbichler et al.
6,631,738 B1 10/2003 Jiang
6,811,103 B1 * 11/2004 Gurich et al. ..... 239/533.2
2002/0043569 A1 4/2002 Boecking (Continued)

FOREIGN PATENT DOCUMENTS

EP 1 143 139 B1 10/2001

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4-5, 2000, Vienna, Austria.

(Continued)

*Primary Examiner*—Mahmoud Gimie
(74) *Attorney, Agent, or Firm*—Liell & McNeil

(57) ABSTRACT

A common rail single fluid fuel injection system includes fuel injectors with a single electrical actuator but the ability to produce ramp, square and split injection rate shapes. This is accomplished by including a control valve member that is operably coupled to the electrical actuator and is movable between a high pressure seat and a low pressure seat. A fuel supply passage is opened to a nozzle passage by moving an admission valve member from a closed position to an open position by relieving fuel pressure on a control surface via movement of the control valve member. In addition, a needle valve member is movable from a closed position to an open position by relieving pressure on a closing hydraulic surface associated with the needle valve, which is again accomplished via movement of the control valve member via the electrical actuator.

20 Claims, 7 Drawing Sheets

U.S. PATENT DOCUMENTS

| | | | | |
|---|---|---|---|---|
| 2002/0084347 | A1 | 7/2002 | Boecking | |
| 2004/0011331 | A1 | 1/2004 | Brocco et al. | |
| 2005/0263133 | A1* | 12/2005 | Magel | 123/446 |

OTHER PUBLICATIONS

Flaig, Polach, Ziegler, Common Rail System (CR-System) for Passenger Car Dl Diesel Engines; Experiences with Applications for Series Production Projects; Technology for Diesel Fuel Injection and Sprays; Mar. 1-4, 1999; pp. 1-10; 1999-01-0191; SAE Technical Paper Series; Detroit Michigan.

Guerrassi, Dupraz; A Common Rail Injection System For High Speed Direct Injection Diesel Engines; Diesel Fuel Injection and Sprays; Feb. 23-26, 1998; pp. 1-8; 980803; SAE Technical Paper Series; Detroit Michigan.

* cited by examiner

10 MICRON
25 MICRON
80 MICRON
1
44
0
T

10 MICRON
25 MICRON
80 MICRON
1
60
0
T

10 MICRON
25 MICRON
80 MICRON
1
71
0
T

10 MICRON
25 MICRON
80 MICRON
102
Q
T

SINGLE FLUID INJECTOR WITH RATE SHAPING CAPABILITY

TECHNICAL FIELD

The present disclosure relates generally to single fluid fuel injection systems, and more particularly to such a fuel injection system with rate shaping capabilities.

BACKGROUND

Engineers have come to recognize that undesirable engine emissions, such as $NO_X$, particulates and unburnt hydrocarbons, can be reduced across an engine's operating range with fuel injection systems with maximum flexibility in controlling injection timing, flow rate, injection quantity, injection rate shapes, end of injection characteristics and other factors known in the art. The desire for maximum flexibility is often tempered by the need to manage costs associated with fuel injection system components and manufacturability, the need for a robust system, the desire to reduce performance variations among fuel injectors in a system, and other factors known in the art. These issues were initially addressed by introducing an electrical actuator into fuel injectors in order to gain some threshold controllability over injection timing and quantity independent of engine crank angle. In the case of common rail fuel injection systems, this threshold control is often accomplished either by including an electronically controllable admission valve or an electronically controllable direct control needle valve. In the former case, the fuel injector's nozzle chamber is opened and closed to a fluid connection with the high pressure fuel rail by opening and closing an admission valve via an electrical actuator. In some instances, the admission valve is directly coupled to an electrical actuator, such as a solenoid, and in other instances the admission valve is pilot operated. In other common rail fuel injection systems, the nozzle chamber remains fluidly connected to the high pressure rail at all times, but the nozzles are opened and closed by relieving pressure on a closing hydraulic surface of a direct control needle valve. Although these common rail fuel injection systems have many desirable aspects, the ability to maximize flexibility in injection characteristics has remained ellusive.

In one example common rail fuel injector disclosed in U.S. Pat. No. 5,984,200 to Augustin, a pilot operated admission valve supposedly includes features that allow the fuel injector to provide a relatively slow rate of injection toward the beginning of an injection event to produce what is commonly referred to in the art as a ramp shaped injection event. While it is true that ramp shaped injection events have proven effective in reducing undesirable emissions at some engine operating conditions, other engine operating conditions often demand different injection characteristics to effectively reduce undesirable emissions. Among these other desired injection characteristics are split injections, the ability to produce square front end injection rate shapes, and the ability to abruptly end injection events. Thus, it has proven problematic to produce common rail fuel injectors with an expanded range of capabilities.

The present invention is directed to overcoming one or more of the problems set forth above.

SUMMARY OF THE DISCLOSURE

In one aspect, a fuel injector includes an injector body with a fuel supply passage, a fuel drain passage, a nozzle passage, an admission control chamber and a needle control chamber. A control valve is attached to the injector body and includes a control valve member operably coupled to an electrical actuator. The control valve member is movable between a first position and a second position. An admission valve member is positioned in the injector body and is movable between a first position in which the fuel supply passage is open to the nozzle passage, and a second position in which the fuel supply passage is closed to the nozzle passage. The admission valve member includes a control surface exposed to fluid pressure in the admission control chamber. A direct control needle valve includes a member with a closing hydraulic surface exposed to fluid pressure in the needle control chamber.

In another aspect, a method of injecting fuel includes a step of opening a nozzle passage to a fuel supply passage by moving an admission valve member from a first position to a second position. Pressure on a closing hydraulic surface of a member of a direct control needle valve is relieved. The opening and relieving steps are accomplished at least in part by moving a control valve member from a first position to a second position. The control valve member is moved by energizing an electrical actuator.

DETAILED DESCRIPTION

Figure 1:
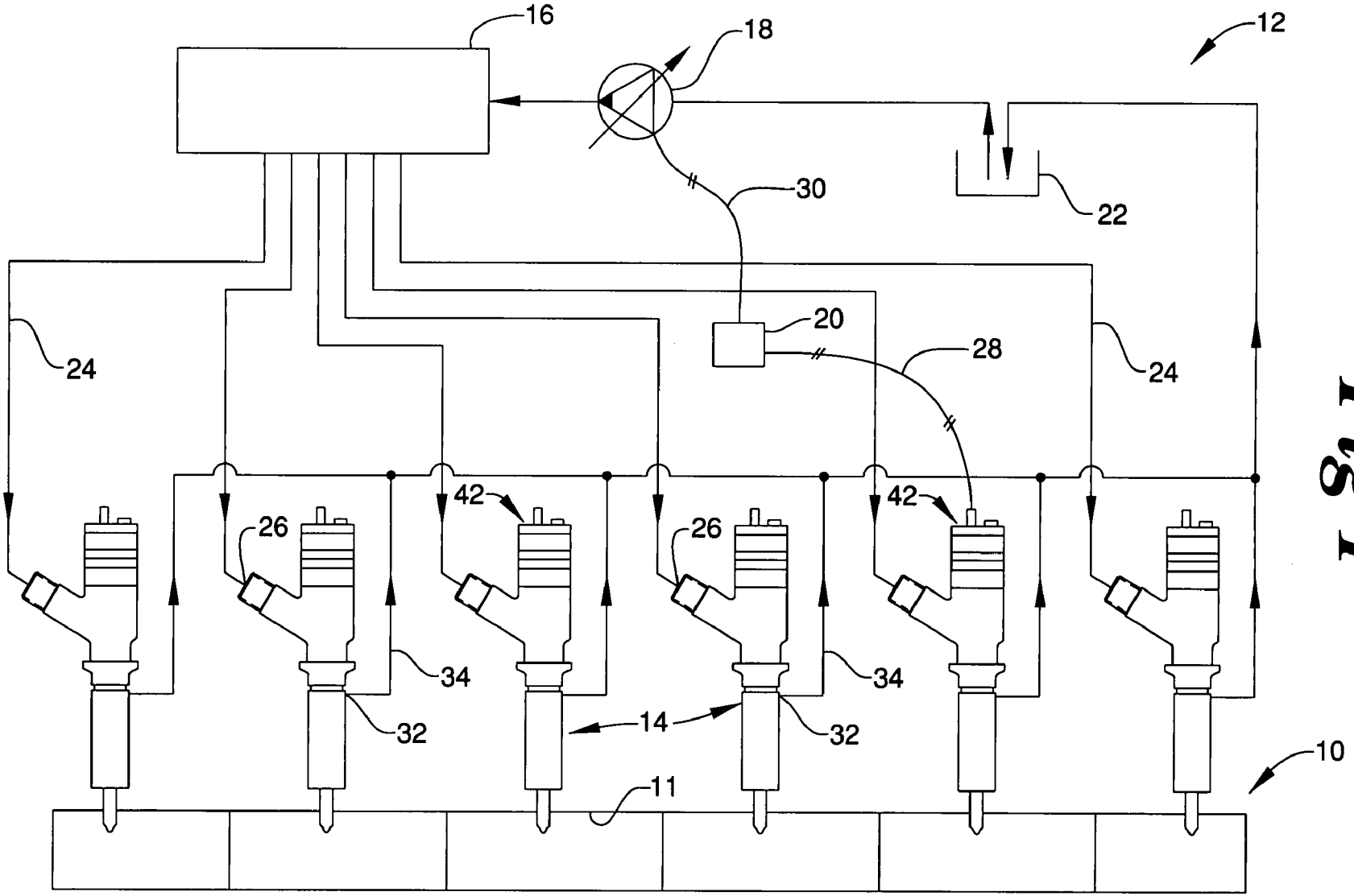
FIG. 1 is a schematic illustration of an engine with a fuel injection system according to the present disclosure.

Referring now to FIG. 1, an engine (10) includes a plurality of cylinders (11) and a fuel injection system (12). Each cylinder (11) has the tip of a single fuel injector (14) at least partially positioned therein for direct fuel injection, such as for a compression ignition engine. Fuel injection system (12) includes a common rail (16) containing pressurized fuel that is fluidly connected to an inlet (26) of each of the fuel injectors (14) via individual fuel supply lines (24). Each fuel injector (14) also includes a drain outlet (32) that is fluidly connected to a low pressure fuel reservoir (22) via drain lines (34). Fuel in a common rail (16) is pressurized by a pump (18), which draws fuel from low pressure reservoir (22) in a well known manner. Pump (18) is preferably electronically controlled by an electronic control module (20) via a control communication line (30). However, those skilled in the art will appreciate that fuel pressure in common rail (16) can be controlled in other ways, such as via an electronically controlled spill valve. Each of the fuel injectors includes a single electrical actuator (42) that is controlled by electronic control module (20) via individual control communication lines (28), only one of which is shown. Although the single electrical actuator (42) is shown as a solenoid, those skilled in the art will appreciate that other actuators, such as a piezo electric stack or bender actuator could be substituted in its place.

Figure 2:
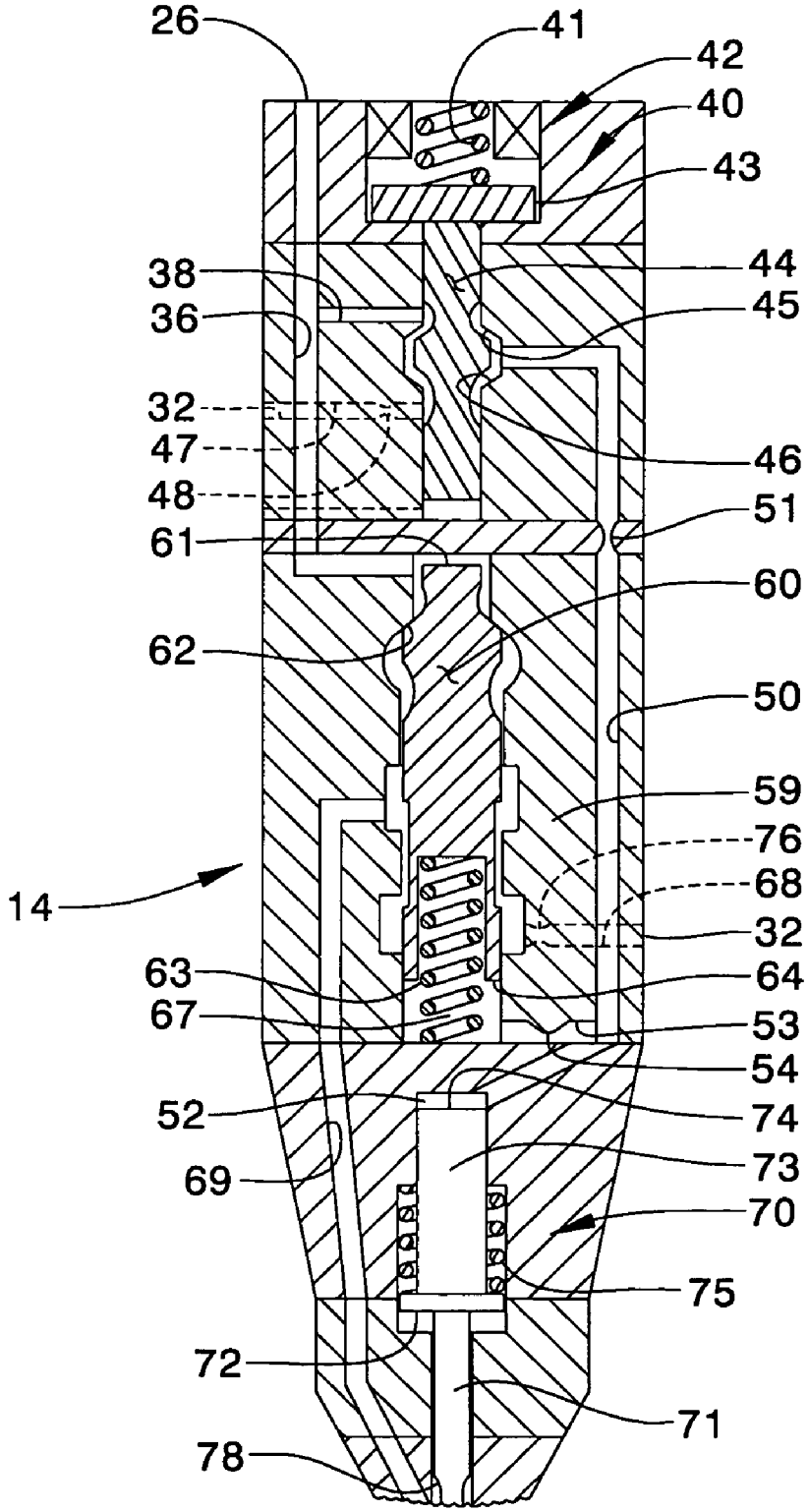
FIG. 2 is a partial sectioned side diagrammatic view of a fuel injector from the fuel system of FIG. 1.

Referring now to FIG. 2, the internal structure and fluid circuitry of each fuel injector (14) is illustrated. In particular, the fuel inlet (26) is connected to a fuel supply passage (36), which is separated from a nozzle passage (69) by an admission control valve (59), that is shown in its closed position closing high pressure seat (62). The operation of the fuel injector (14) is controlled by a control valve (40) that includes a control valve member (44) that moves between a low pressure seat (46) and a high pressure seat (45). Control valve member (44) is operably coupled to electrical actuator (42), which in this example includes an armature (43). Control valve member (44) and armature (43) are normally biased downward to close low pressure seat (46) via a biasing spring (41). When control valve member (44) is in its downward position closing low pressure seat (46), a pressure control passage (50) is fluidly connected to fuel supply passage (36) via a branch passage (38). When electrical actuator (42) is energized, armature (43) and control valve member (44) are lifted upwards to close high pressure seat (45) and open low pressure seat (46), such that pressure control passage (50) is then fluidly connected to drain outlet (32) via drain passage (47). If desired, drain passage (47) can include a flow restriction (48) to slow the flow rate through drain passage (47) to achieve a desired effect.

Pressure control passage (50), which can include a flow restriction (51), is fluidly connected to an admission control chamber (67) via a branch passage (53) and also to a needle control chamber (52). Branch passage (53) preferably includes a flow restriction (54) or some other flow affecting feature, such as a passive valve and/or specially shaped passage to produce some flow characteristic. Admission valve (50) includes an admission valve member (60) that is normally biased upward toward its closed position to close high pressure seat (62) by a biasing spring (63), as shown. In addition, a hydraulic force in admission control chamber (67) acts upon a control surface (64) of admission valve member (60) in opposition to an opening hydraulic surface (61) that is always exposed to high pressure in fuel supply passage (36). Although not necessary, the effective area of opening hydraulic surface (61) is preferably about equal to the effective area of control surface (64), such that spring (63) urges admission valve member (60) upward toward its closed position when admission control chamber (67) is fluidly connected to fuel supply passage (36) past high pressure seat (45).

When the admission valve member (60) is in its upward first position as shown, nozzle passage (69) is fluidly connected to drain passage (68), which can include a flow restriction (76). Thus, between injection events, nozzle passage (69) is at low pressure via the connection to drain passage (68), and is fluidly isolated from high pressure fuel supply passage (36) by poppet seat (62), which is preferably a conical valve seat of a type well known in the art. When control valve member (44) is lifted upward to close high pressure seat (45), admission control chamber (67) becomes fluidly connected to low pressure drain passage (47), such that the high pressure force acting on opening hydraulic surface (61) moves admission valve member (60) downward to open poppet seat (62) and close the fluid connection to drain (68). Thus, when admission valve member (60) is moved downward, fuel supply passage (36) becomes fluidly connected to nozzle passage (69), which opens to nozzle outlets (not shown) when needle valve member (71) is lifted to its upward open position.

In this embodiment, direct control needle valve (70) includes a needle valve member (71), a lift spacer (72) and a needle piston (73). Needle valve member (71) is normally biased downward toward its closed position to close the nozzle outlets (not shown) via a biasing spring (75). Needle piston (73) includes a closing hydraulic surface (74) exposed to fluid pressure in needle control chamber (52). When control valve member (44) is in its normally biased downward closed position to close low pressure seat (46) and open high pressure seat (45), needle control chamber (52) is pressurized such that needle valve member (71) will stay in, or move toward, its downward closed position. However, when electrical actuator (42) is energized to close high pressure seat (45) and open low pressure seat (46), fluid pressure in needle control chamber (52) is relieved. If fuel pressure in nozzle passage (69) is above a valve opening pressure at that time, needle valve member (71), lift spacer (72) and needle piston (73) will lift upward to open the nozzle outlets to commence the spray of fuel from fuel injector (14). The opening force on the needle valve (70) acts upon an opening hydraulic surface (78) on needle valve member (71) in a conventional manner.

Figure 4:
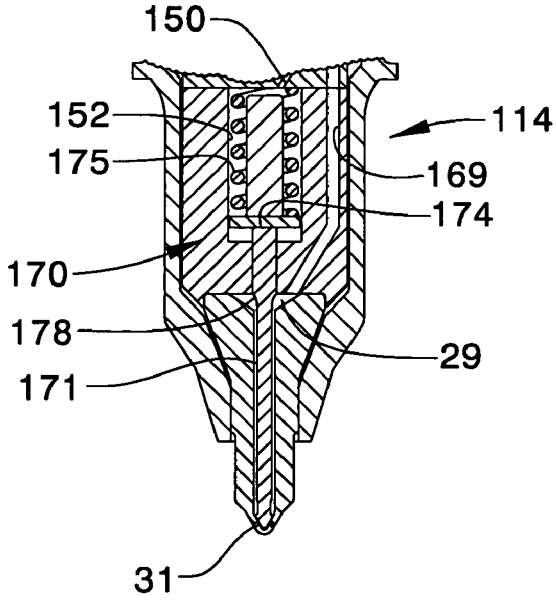
FIG. 4 is a partial section side diagrammatic view of a fuel injector according to another aspect of the disclosure.

Referring now to FIG. 4, a fuel injector (114) according to another embodiment is substantially identical to fuel injector (14) except that its direct control needle valve (170) includes a needle valve member (171) that itself includes a closing hydraulic surface (174). Recalling that the embodiment of FIG. 2 locates its closing hydraulic surface (74) on a needle piston member (73) that can be a separate piece from the needle valve member (71). In the case of direct control needle valve (170), the needle valve member (171) is preferably hydraulically balanced such that when it is lifted upward to its open position, the effective area of closing hydraulic surface (174) and the combined effective areas of opening hydraulic surface (178) and that area exposed adjacent to nozzle outlets (31) are about equal. In other words, if fluid pressure in needle control chamber (152) is about the same as fluid pressure in nozzle chamber (29), needle valve member (171) will stay in or move toward its downward closed position under the action of biasing spring (175). Otherwise, fuel injector (114) is identical to fuel injector (14). In other words, nozzle chamber (29) is fluidly connected to a nozzle passage (169), which is opened and closed to a fuel supply passage (36) via an admission control valve (59). In addition, needle control chamber (152) is fluidly connected to the control valve (40) via a pressure control passage (150).

Figure 3:
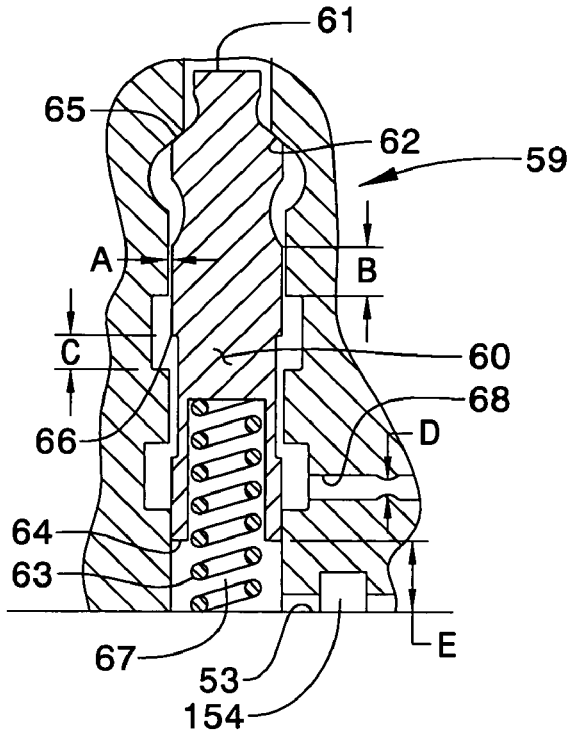
FIG. 3 is a schematic illustration of an admission valve according the present disclosure.

Referring now to FIG. 3, a schematic view of an admission valve (59) according to the present disclosure includes a variety of design parameters A–E that allow for the selection of particular performance characteristics. Dimension A is referred to as the clearance sweep magnitude, which is a flow restriction existing between the outer surface of admission valve member (60) and the inner diameter of the bore within which the valve member is positioned. As A becomes smaller, admission valve (59) begins to act more like a spool valve when opening and closing nozzle passage (69) to fuel supply passage (36). When clearance A becomes larger, admission valve (59) acts like a simple poppet valve and its fluidly opening and closing the connection between fuel supply passage (36) and nozzle passage (69). However, there exists a range of clearances, which depend upon the particular application, in which the fluid connection between fuel supply passage (36) and nozzle passage (69) will be restricted over a portion of admission valve member's (60) travel distance E from its first position as shown to its downward second position.

The dimension B is referred to as the clearance sweep length, and is typically, but not necessarily, shorter than the travel distance E of the admission valve member (60). In other words, clearance sweep length B determines the length of the segment of the admission valve member's travel distance E in which the fluid connection between the fuel supply passage (36) and nozzle passage (69) is restricted. Those skilled in the art will appreciate that by introducing this flow restriction into the fluid connection while the admission valve member (60) is moving, the fuel pressure in nozzle passage (69) can be made to rise more gradually to produce front end rate shaping, such as a ramp front end shape. The pressure in nozzle passage (69) while admission valve member (60) is moving can be influenced by other design features such as the drain open segment C which determines how long nozzle passage (69) remains opened to drain passage (68) while admission valve member (60) is moving downward toward its downward second position. In addition, by locating a flow restriction in drain passage (68), the fluid pressure in nozzle passage (69) can also be affected. In other words, nozzle passage (69) is not closed to drain passage (68) until spool valve surface (66) moves adjacent the shoulder defined by the bore in which the admission valve (60) moves. The distance that the admission valve member (60) must move before the spool valve edge is adjacent to that shoulder is the Dimension C. However, if the flow restriction D is too large, pressure will not be able to build in nozzle passage (69) while the drain passage (68) remains opened so that fuel injection will not occur, even at lower pressure levels, until the Dimension C is taken up and the drain passage (68) is closed. On the other hand, if the drain (68) is eliminated altogether, fuel pressure in nozzle passage (69) would be trapped between injection events. Thus, there exists a range of flow restriction flow areas D that allow fuel pressure in nozzle passage (69) to get above a valve opening pressure sufficient to open the direct control needle valve (70, 170) while the admission valve member (60) is moving from its upward first position toward its downward second position. In other words, while the admission valve member (60) is moving toward its downward second position, fuel pressure in nozzle passage (69) can be at a reduced but growing level sufficient to open the direct control needle valve member (72) to produce front end rate shaping.

Another feature of the present disclosure relates to flow control feature (54). In the embodiment of FIG. 2, this feature was a simple flow restriction orifice. It is this feature that is useful in slowing the travel rate of the admission valve member (60) from its upward first position to its downward second position. In other words, by restricting the flow rate of fuel that must be displaced from admission control chamber (67) into branch passage (53), the movement rate of admission valve member (60) can be slowed such that the various design features will have time to produce the desired front end rate shaping effects. In other words, if admission valve member (60) moves from its first position to its downward second position too quickly, the various features A–E will have little effect. On the other hand, the admission valve member should have the ability to fully retract and close high pressure admission seat (62) between injection events. Thus, if the flow restriction (54) (FIG. 2) is too large, the admission valve member (60) will move quickly from its first position to its second position resulting in little or no rate shaping effects. On the other hand, if the flow restriction (54) is too small, the admission valve (59) may be unable to fully retract and reset itself between injection events. Thus, it may be desirable for the fluid flow leaving admission control chamber (67) to be more resistive than fluid flowing into admission control chamber (67). In the embodiment of FIG. 3, this can be accomplished, for instance, by including a passive valve of the type described in co-owned U.S. Pat. No. 6,631,738 to Jiang that includes a ball valve member that moves to make the passage more restrictive to fluid in one direction than it is to the fluid flow in the other direction. In addition, flow control feature (154) could be a specially shaped passage such as that shown in co-owned U.S. Pat. No. 6,024,296 to Wear et al. that is more resistive to fluid flow in one direction than it is to fluid flow in an opposite direction. It is this aspect of the disclosure that also influences how quickly admission valve member (60) can move toward its upward first position to reset for a subsequent injection event.

Another design aspect that contributes to the ability of fuel injector (14, 114) to produce split injections could be referred to as a histeresis effect. In other words, the ability for admission valve member (60) to change its movement direction, or move sufficiently far from its downward second position toward its upward first position to close high pressure seat (62), should be sluggish relative to the ability of control valve member (44) and needle valve member (71) to move between their first and second positions. This can be influenced by the various surface areas, flow restrictions, mass properties, spring preloads, etc. on the various valve members.

It is this aspect of the disclosure that can allow for fuel injector (14, 114) to produce split injections and square end front rate shapes. In other words, a square front end rate shape can be produced by initially moving control valve member (44) upward to open low pressure seat and relieve pressure in admission control chamber (67) so that the admission valve member (60) begins moving downward to commence an injection event. However, before fuel pressure in nozzle passage (69) reaches a valve opening pressure, the electrical actuator (42) is briefly de-energized to reopen high pressure seat (45). However, because of the downward momentum of admission valve member (60), it does not reverse direction and close high pressure seat (62), but the quick action of direct control needle valve (70) causes it to briefly close while pressure continues to build in nozzle chamber (69). At some desired timing while admission valve member (60) is still moving downward or when it has reached its second position, the electrical actuator (42) is again energized to close high pressure seat (45) and reopen low pressure seat (46) to relieve pressure in needle control chamber (52) so that direct control needle valve (70) can lift to its upward open position and commence the spray of fuel at a substantially higher pressure than a valve opening pressure defined by the biasing spring (75) preload and the magnitude of the opening hydraulic surface (78). In other words, the injection event can commence at near full pressure with fuel pressure in nozzle passage (69) about equal to the fuel pressure in fuel supply passage (36). Thus, by opening and closing the control valve (40) while the admission valve member (60) is moving, the various design features A–E can be overcome to produce little or no effect on the resulting injection event.

INDUSTRIAL APPLICABILITY

Although the present disclosure could find potential application in virtually any type of fuel injection system, including but not limited to cam actuated and hydraulically actuated fuel injection systems, the disclosure finds a preferred application in common rail fuel injection systems. In addition, the disclosure finds a preferred application in two-wire common rail fuel injection systems with a demand for substantial fuel injector performance capabilities while maintaining relatively low cost. In addition, the present disclosure finds preferred application in single fluid, namely fuel, fuel injection systems. Although the disclosure is illustrated in the context of a compression ignition engine, the disclosure could find application in other engine applications, including but not limited to spark ignited engines. Although the fuel injection system (12) illustrated includes only a single electrical actuator (42) per fuel injector (14, 114), it has the capability of producing ramp injection shapes, square injection shapes, split injections, and relatively abrupt injection endings. Furthermore, these different injection profiles can be selected independent of engine operating condition. Finally, like many electronically controlled fuel injection systems, the fuel injectors (14, 114) have relatively precise control over injection timing and quantity, which can be selected independent of engine speed, load and crank angle.

Figure 5A:
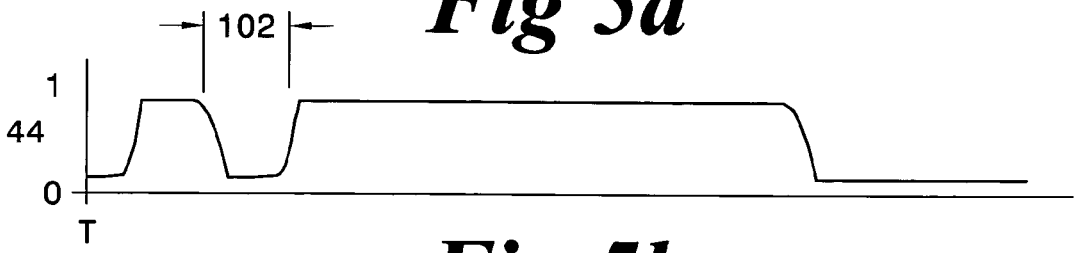
FIG. 5A is graph of control valve member position versus time for an example square injection event according to the present disclosure.
Figure 5B:
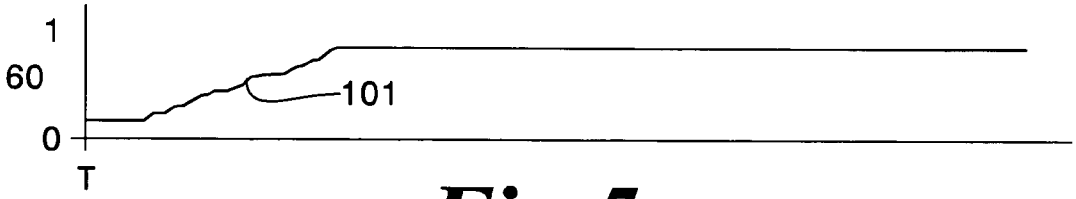
FIG. 5B is a graph of admission valve member position versus time for the injection event of FIG. 5A.
Figure 5C:
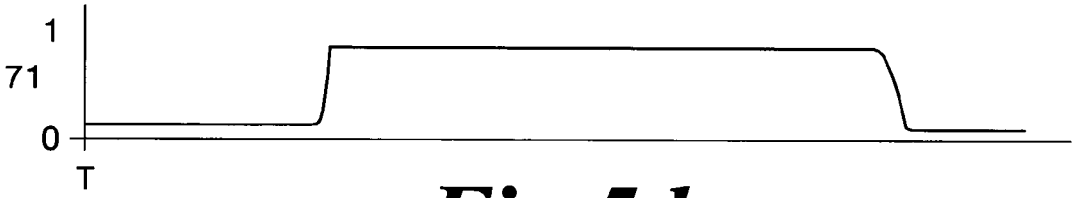
FIG. 5C is a graph of needle valve member position versus time for the fuel injection event of FIGS. 5A and B.
Figure 5D:
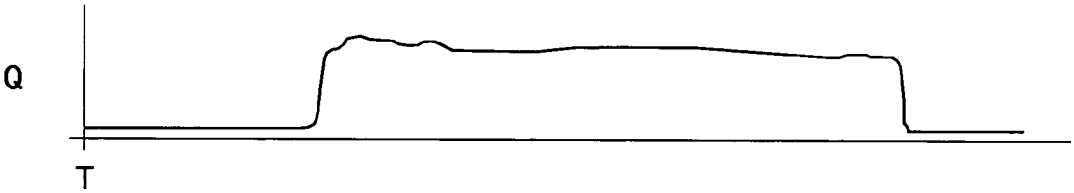
FIG. 5D is a graph of injection flow rate versus time for the fuel injection event of FIGS. 5A–C.

Referring to FIGS. 2–4 and FIGS. 5–5A–D, a square injection rate shape is produced by energizing and de-energizing the electrical actuator (42) associated with the control valve (40) twice during the injection event. As shown in FIG. 5A, before the injection event is initiated, the electrical actuator (42) is de-energized and control valve member (44) is in its downward position closing low pressure seat (46) and opening high pressure seat (45). When in this position, the pressure forces acting on opening hydraulic surface (61) and control surface (64) of admission valve member (60) are relatively balanced such that the biasing spring (63) urges admission valve member (60) upward to maintain seat (62) closed. Thus, before the injection event is initiated, fuel supply passage (36) is blocked to nozzle passage (69), which is at low pressure via its connection to drain (68). Also, direct control needle valve (70) is in its closed position due to the biasing force of biasing spring (75), and the high pressure acting on closing hydraulic surface (74) in needle control chamber (52). The injection event is initiated by energizing electrical actuator (42) and pulling armature (43) and control valve member (44) upward to close high pressure seat (45) and open low pressure seat (46). This relieves pressure on control surface (64) due to a pressure drop in admission control chamber (67), which causes the admission valve member (60) to begin moving downward to open seat (62). FIG. 5B shows admission valve member (60) beginning to move from its seated position toward its downward stop against the action of biasing spring (63). As this occurs, pressure in nozzle passage (69) begins to build. However, before that pressure reaches a valve opening pressure sufficient to cause needle valve member (71) to lift and open the nozzle outlets, the electrical actuator (42) is de-energized to reopen high pressure seat (45) and close low pressure seat (46). Because fuel pressure has not yet achieved a valve opening pressure, the needle valve member remains in its closed position as shown in FIG. 5C. However, the admission valve member (60) begins to slow in its downward movement as shown at ledge 101 in FIG. 5B. Still, the fluid connection between fuel supply passage (36) and nozzle passage (69) remains open, and pressure in nozzle passage (69) continues to increase beyond the valve opening pressure. At some timing before admission valve member (60) reverses direction and actually closes seat (62), electrical actuator (42) is re-energized to reopen low pressure seat (46) and reclose high pressure seat (45). This relieves pressure in needle control chamber (52) and allows the needle valve member (71) to lift to its upward open position as shown in FIG. 5C. When this occurs, the injection of fuel commences at a relatively high pressure as shown by the relatively square front end rate shape shown in FIG. 5D.

The injection event is abruptly ended at some desired timing by again de-energizing electrical actuator (42) to reopen high pressure seat (45) and close low pressure seat (46) to reapply high pressure to the closing hydraulic surface (74) of direct control needle valve (70) causing it to move downward toward its close position to close the nozzle outlets (31) under the action of the hydraulic force in needle control chamber (52) and the force from biasing spring (175). In the case of the fuel injector (114) of FIG. 4, the downward force would be substantially only from the biasing spring (175) as the needle valve member (171) would be substantially hydraulically balanced when the injection event is ended. Those skilled in the art will appreciate that by varying the duration of the dwell (102) in FIG. 5A, different injection rate shapes can be produced from a square, a partial ramp, and possibly even a fuel injection event that starts out high, dips low and then returns to a maximum level. To do this latter type of injection event, the dwell would be such that the admission valve member reverses direction and moves toward its seat (62) but its direction is again reversed before it actually closes admission seat (62).

Figure 6A:
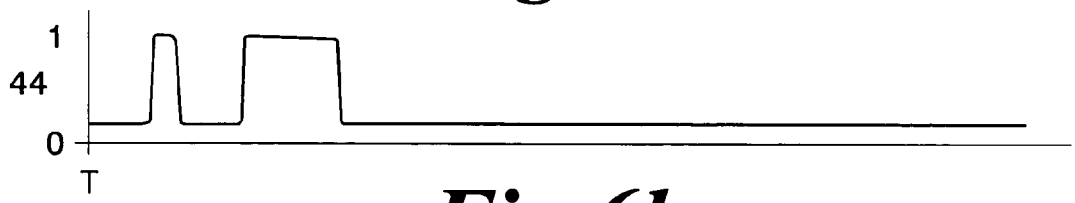
FIG. 6A is a graph of control valve member position versus time for a split injection event according to the present disclosure.
Figure 6B:
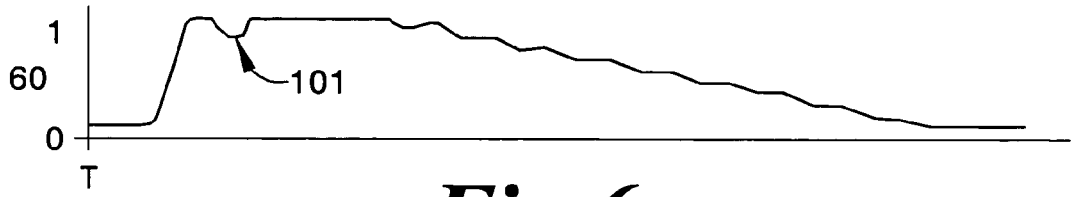
FIG. 6B is a graph of admission valve member position versus time for the split injection event of FIG. 6A.
Figure 6C:
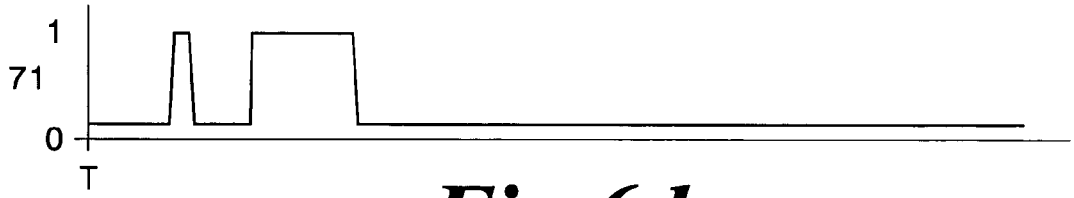
FIG. 6C is a graph of needle valve member position versus time for the split injection event of FIGS. 6A and B.
Figure 6D:
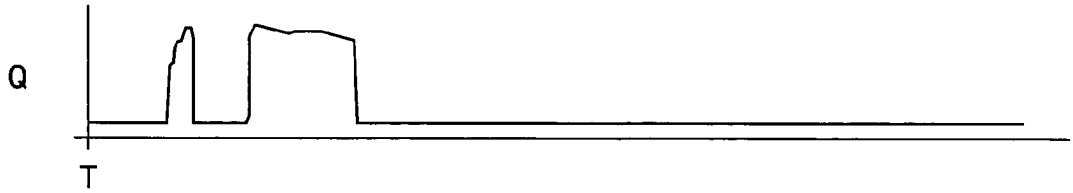
FIG. 6D is a graph of injection flow rate versus time for the split injection event of FIGS. 6A–C.
Figure 7A:
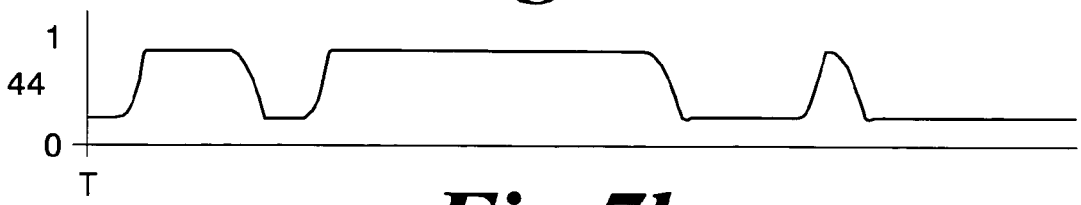
FIG. 7A is a graph of control valve member position versus time for a multiple injection event according to another aspect of the disclosure.
Figure 7B:
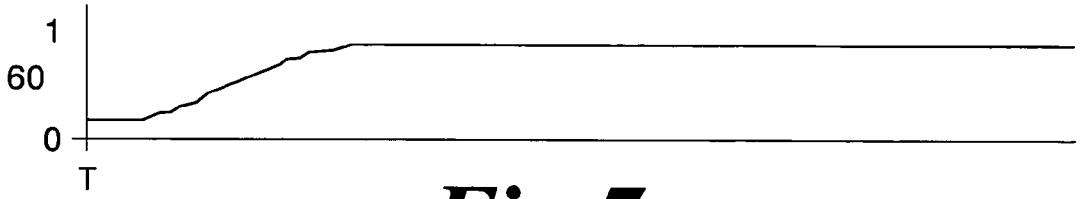
FIG. 7B is a graph of admission valve member position versus time for the injection sequence of FIG. 7A.
Figure 7C:
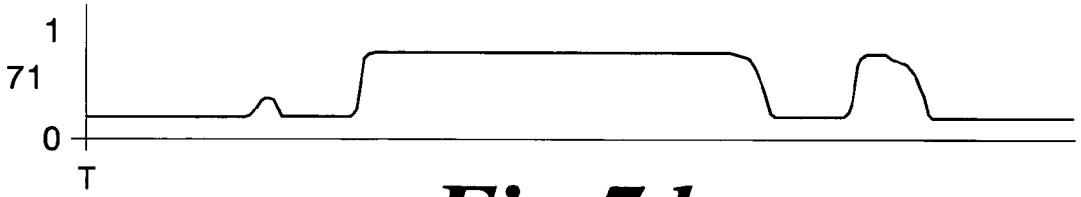
FIG. 7C is a graph of needle valve member position versus time for the injection sequence of FIGS. 7A and B.
Figure 7D:
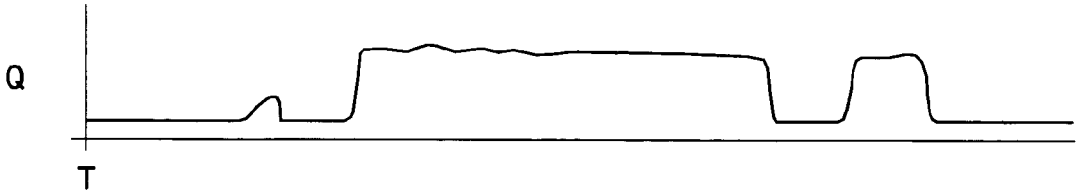
FIG. 7D is a graph of injection flow rate versus time for the multiple injection sequence of FIGS. 7A–C.

Referring to FIGS. 6A–D, an example split fuel injection sequence is illustrated. In this example sequence, the electrical actuator (42) is initially energized for a sufficient duration that fuel pressure in nozzle passage (69) rises above a valve opening pressure and the needle valve member (71) lifts to an open position to commence spray as shown in FIG. 5 and FIGS. 6C and D. However, a split injection is initiated by de-energizing electrical actuator (42) to move control valve member (44) downward to reopen high pressure seat (45). When this occurs, fuel pressure quickly rises in needle control chamber (52) causing the direct control needle valve (70) to move to its downward closed position to cease injection. Also, fuel pressure rises in admission control chamber (67) and the admission valve member (60) begins moving upward toward seat (62). However, the electrical actuator (42) is again energized before the admission valve member can close the fluid connection between fuel supply passage (36) and nozzle passage (69) as shown in the dip in movement (101) in FIG. 6B. Thus, the movement of admission valve member (60) is relatively sluggish compared to that of control valve member (44) and direct control needle valve (70). While the direct control needle valve (70) can be opened and closed, the admission valve member (60) is relatively sluggish in its movement such that the fluid connection between fuel supply passage (36) and nozzle passage (69) is maintained. As such, the second portion of the injection event is initiated by re-energizing electrical actuator (42) to relieve pressure in needle control chamber (52) and the direct control needle valve (70) again lifts to its open position. At about the same time, the admission valve member (60) moves back into contact with its downward stop. Those skilled in the art will appreciate that this example illustrates a split injection where the main injection event has a square rate shape.

Those skilled in the art will appreciate that a split injection where the main injection event includes a ramp front end shape may require a substantially longer dwell such that admission valve member is allowed to move much further toward seat (62) such that the clearance sweep A and D (FIG. 3) plays a part in the main injection event. Also, the pilot injection event can be made to have a relatively square shape or ramp shape depending upon a desired injection profile shape. Thus, those skilled in the art will appreciate that a variety of injection shapes and split sequences can be produced by energizing and de-energizing electrical actuator (42) with certain dwells that take into consideration the valve responses and flow areas through the fuel injector (14, 114).

FIG. 6B is also useful in illustrating that the admission valve member (60) can be relatively slow in moving back to reset for a subsequent injection event as shown by the relatively gradual slope after the injection event has occurred. As stated earlier, this reset rate can be affected by how quickly fluid is allowed to flow into admission control chamber (67) due to a flow restriction (54) or some other flow affecting feature (154) as discussed earlier. In any event, it is desirable to adjust this feature such that the admission valve member (60) can completely close its seat (62) between each engine cycle for that particular cylinder at all engine speeds.

Referring to FIGS. 7A–D, a close coupled pilot plus main plus post injection event can be created by energizing and de-energizing electrical actuator (42) to move control valve member back and forth three times between its low pressure seat (46) and high pressure seat (45). Those skilled in the art will appreciate that by adjusting how sluggish the admission valve member's movement is relative to the quick acting control valve member (44) and direct control needle valve (70, 170), a wide variety of injection sequences will be available, and in many instances more performance capabilities are available than in many four-wire fuel injection systems known in the art.

Figure 8A:
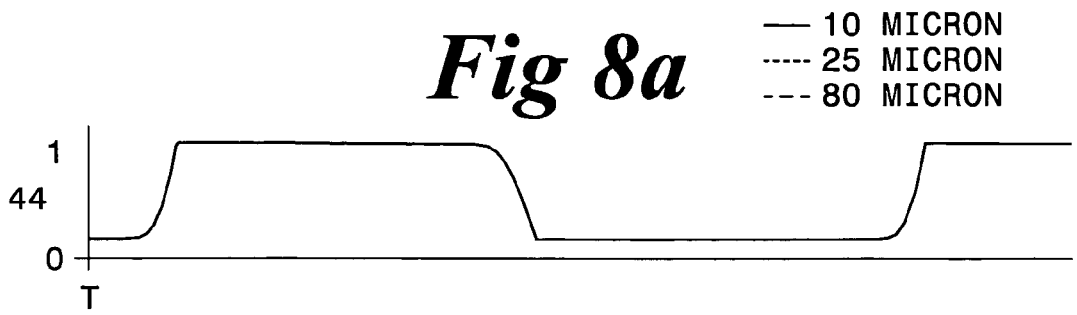
FIG. 8A is a graph of control valve position versus time for a ramp injection event according to another aspect of the disclosure.
Figure 8B:
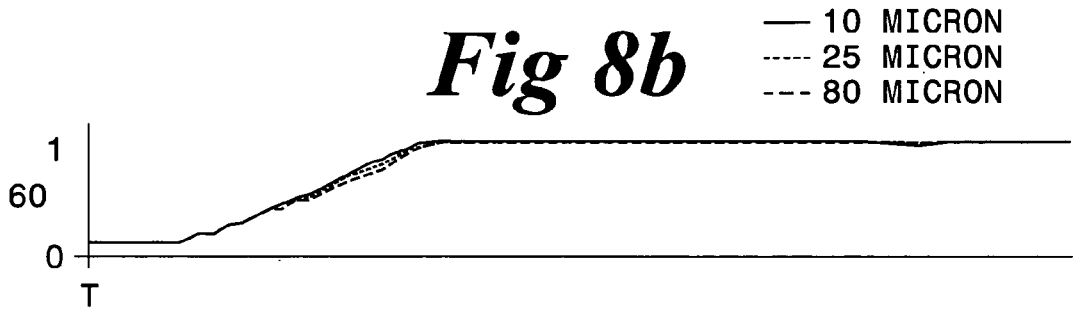
FIG. 8B is a series of graphs of admission valve member position versus time for several different clearance sweep magnitudes.
Figure 8C:
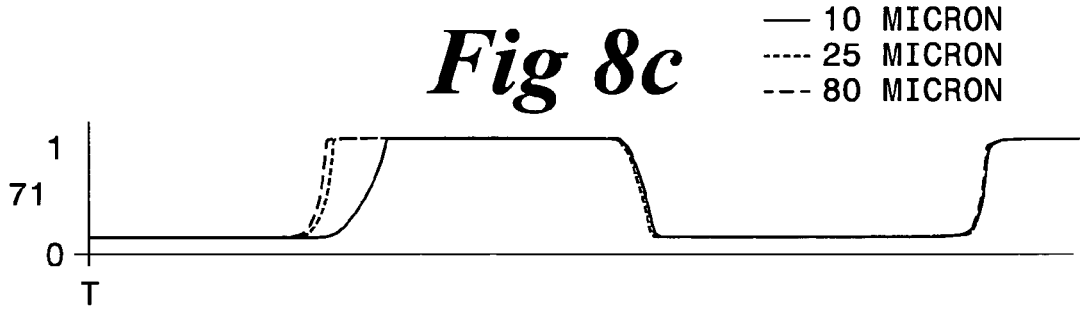
FIG. 8C is a graph of valve member position versus time for the different clearance sweep magnitudes.
Figure 8D:
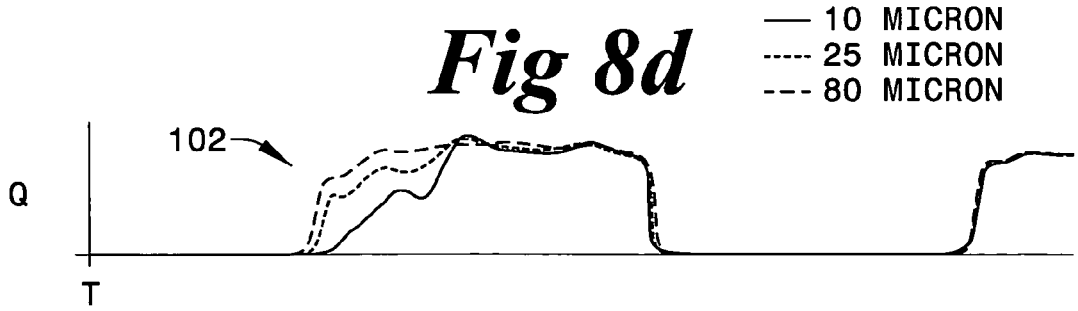
FIG. 8D is a series of several graphs of injection flow rate for the different radial clearance sweep of FIGS. 8A–C.

Referring now to FIGS. 8A–D, several example ramp shaped fuel injection sequences are illustrated relative to different magnitudes of the clearance sweep A as shown in FIG. 3. The rate traces 102 of FIG. 8D illustrate, as expected, that the ramp front end shape is made more gradual by making the clearance sweep A smaller. Nevertheless, those skilled in the art will appreciate that other design criteria can be adjusted to also affect the slope of the front end rate shape including the clearance sweep distance B, the drain open distance C, the total valve travel distance E and the size of the flow restriction D in drain (68). Also, the fuel injection event front end rate shape can be substantially affected by raising or lowering fuel pressure in the common rail (16) in a manner well known in the art. Thus, the fuel injection system (12) of the present disclosure can form a wide variety of precisely control injection sequences in only a two-wire system, whereas many known four-wire fuel injection systems have lesser capabilities.

It should be understood that the above description is intended for illustrative purposes only, and is not intended to limit the scope of the present disclosure in any way. For instance, although admission valve member 60 is shown as being triggered to move by relieving pressure in an admission control chamber, the hydraulic circuitry could be changed such a control chamber is pressurized by energizing actuator (42), rather than relieved as in the illustrated embodiment. Thus, those skilled in the art will appreciate that other aspects, objects and advantages of this invention can be obtained from a study of the drawings, the disclosure and the appended claims.

What is claimed is:

1. A fuel injector comprising:

an injector body with a fuel supply passage, a fuel drain passage, a nozzle passage, an admission control chamber and a needle control chamber;

a control valve attached to said injector body and including a control valve member operably coupled to an electrical actuator, and being movable between a first position and a second position;

an admission valve member positioned in said injector body and being movable between a first position in which said fuel supply passage is open to said nozzle passage, and a second position in which said fuel supply passage is closed to said nozzle passage, and including a control surface exposed to fluid pressure in said admission control chamber;

a needle valve including a member with a closing hydraulic surface exposed to fluid pressure in said needle control chamber, and an opening hydraulic surface exposed to fluid pressure in said nozzle passage; and a pressure control passage extending between said control valve and said needle control chamber.

2. The fuel injector of claim 1 wherein each of said admission control chamber and said needle control chamber is fluidly connected to one of said fuel drain passage and said fuel supply passage when said control valve member is in one of said first position and said second position.

3. The fuel injector of claim 2 wherein each of said admission control chamber and said needle control chamber is fluidly blocked from one of said fuel drain passage and said fuel supply passage when said control valve member is in one of said first position and said second position.

4. The fuel injector of claim 3 wherein both said admission control chamber and said needle control chamber are fluidly connected to said fuel supply passage when said control valve member is in said first position; and both said admission control chamber and said needle control chamber are fluidly connected to said fuel drain passage when said control valve member is in said second position.

5. The fuel injector of claim 4 wherein said admission valve member moves a travel distance between said first position and said second position;

said nozzle passage being fluidly connected to both said fuel supply passage and said fuel drain passage for a portion of said travel distance.

6. The fuel injector of claim 4 wherein said admission valve member moves a travel distance between said first position and said second position;

said nozzle passage is fluidly connected to said fuel supply passage via a restricted flow area over a predetermined segment of said travel distance, but being fluidly connected via an unrestricted flow area when said admission valve member is in said second position.

7. The fuel injector of claim 6 wherein said restricted flow area is an annular clearance between said admission valve member and said injector body; and said predetermined segment has a clearance sweep length.

8. The fuel injector of claim 1 wherein said admission valve member moves between a poppet seat and a stop surface; and said admission valve member including a poppet valve surface with respect to said fuel supply passage, and a spool valve surface with respect to said fuel drain passage.

9. The fuel injector of claim 1 wherein said admission valve member includes an opening hydraulic surface always exposed to fluid pressure in said fuel supply passage; and a biasing spring operably positioned in said admission control chamber to bias said admission valve member in opposition to a hydraulic force on said opening hydraulic surface.

10. A fuel injection system comprising:

a common rail;

a plurality of fuel injectors according to claim 1 fluidly connected to said common rail.

11. The fuel injection system of claim 10 wherein said common rail contains pressurized fuel.

12. A method of injecting fuel, comprising the steps of:

opening a nozzle passage to a fuel supply passage by moving an admission valve member from a first position to a second position;

relieving pressure on a closing hydraulic surface of a member of a needle valve;

exposing an opening hydraulic surface of the needle valve to fluid pressure in the nozzle passage;

the opening and relieving steps being accomplished at least in part by moving a control valve member from a first position to a second position at which the needle control chamber is fluidly connected to a drain passage; and the control valve member being moved by energizing an electrical actuator.

13. The method of claim 12 wherein the admission valve member is moved from the first position to the second position by relieving pressure on a control surface of the admission valve member.

14. The method of claim 12 including injecting fuel at a low rate by limiting fuel flow between the fuel supply passage and the nozzle passage while the admission valve member is moving from its first position to its second position.

15. The method of claim 14 wherein the limiting step includes a step of restricting fuel flow between the fuel supply passage and the nozzle passage for a segment of a travel distance for the admission valve member.

16. The method of claim 14 wherein the limiting step includes displacing fuel from an admission control chamber during the admission valve member movement step; and restricting the flow of fuel from the admission control chamber during the displacing step.

17. The method of claim 16 including a step of closing the nozzle passage to the fuel supply passage by moving the admission valve member from its second position to its first position; and hastening a movement rate of the admission valve member from its second position to its first position at least in part by reducing a resistance to fuel flow relative to the restricting step.

18. The method of claim 14 wherein the limiting step includes opening the fuel supply passage to a drain passage over a portion of the movement of the admission valve member from its first position to its second position.

19. The method of claim 12 including a step of splitting injection at least in part by de-energizing the electrical actuator and then re-energizing the same before the admission valve member can move back to its first position.

20. The method of claim 12 including a step of ending an injection event at least in part by fluidly connecting a needle control chamber to a common rail.

* * * * *